US007428923B2

(12) United States Patent
Ford

(10) Patent No.: US 7,428,923 B2
(45) Date of Patent: Sep. 30, 2008

(54) TOP PLUNGER ADAPTER

(76) Inventor: Michael B. Ford, 2716 Rio Vista, St. George, UT (US) 84790

( * ) Notice: Subject to any disclaimer, the term of this patent is extended or adjusted under 35 U.S.C. 154(b) by 175 days.

(21) Appl. No.: 11/559,538

(22) Filed: Nov. 14, 2006

(65) Prior Publication Data

US 2008/0112826 A1 May 15, 2008

(51) Int. Cl.
*E21B 43/00* (2006.01)
*F04B 47/12* (2006.01)

(52) U.S. Cl. ..... 166/105.3; 166/105.2; 417/430

(58) Field of Classification Search ... 166/105.1–105.4, 166/369, 68, 68.5; 417/430, 555.2
See application file for complete search history.

(56) References Cited

U.S. PATENT DOCUMENTS 5,018,581 A * 5/1991 Hall ..... 166/373
5,660,534 A * 8/1997 Snow ..... 417/554
6,145,590 A * 11/2000 Havard ..... 166/105.2
7,008,197 B2 * 3/2006 Ford ..... 417/430

* cited by examiner

*Primary Examiner*—John Q. Nguyen
*Assistant Examiner*—Elizabeth C Gottlieb
(74) *Attorney, Agent, or Firm*—Jeffrey Weiss; Weiss & Moy, P.C.

(57) ABSTRACT

There is provided a top plunger adapter assembly for use in controlling sand fouling of an oil pump system wherein the oil pump system reciprocates between upstrokes and downstrokes within a barrel, and wherein the oil pump system includes as components a sucker rod and a plunger. In one embodiment, the top plunger adapter assembly includes an adapter having a first end configured to receive a sucker rod, wherein the adapter includes a chamber which allows fluid movement therethrough; a collection cage rotatably mounted to the adapter, the collection cage defining an interior region, and the collection cage having an upper lip configured to direct sand toward the interior region of the collection cage during an upstroke of the pump; and a bottom cage attached to the adapter and the bottom cage having a bottom end configured to attach to a pump plunger, wherein the bottom cage includes a passage to allow fluid communication through the bottom cage to the chamber of the adapter. In one embodiment, the adapter is further configured with a flute section configured to allow fluid movement from the chamber through the flute section during a downstroke of the pump and wherein the flute section is configured to impart a spiral movement in fluid passing through the flute section.

20 Claims, 3 Drawing Sheets

TOP PLUNGER ADAPTER

FIELD OF THE INVENTION

The present invention relates to mechanical oil pumps actuated by sucker rod reciprocation. More particularly, the invention relates to the connection of sucker rods to pump apparatus through connecting adapters and the control of oil flow therethrough.

BACKGROUND OF THE INVENTION

As the natural pressure in a completed oil well gradually depletes, the well may require a means known as artificial lift to continue the flow of petroleum reserves from their subterranean location to the earth's surface. Various forms of artificial lift are known including, for example, gas injection, water injection, and mechanical pumping. Petroleum engineers select a form of artificial lift depending on a number of criteria including, for example, formation geology and economics. The sucker rod pump is a well-known kind of mechanical pump that is widely used in the petroleum industry.

The sucker rod pumping system typically includes a means of providing a reciprocating (up and down) mechanical motion located at the surface near the well head. A string of sucker rods—up to more than a mile in length—is connected to the mechanical means. The sucker rod string is fed through the well tubing down hole where it is connected to the pump. Often the sucker rod string is first connected to the pump apparatus via a top plunger adapter. In a typical pump configuration, the top plunger adapter provides a transition between the sucker rod string and other pump components such as the pump plunger.

As is known in the art, the pump itself includes other components such as two separate valves (a standing valve and a traveling valve), a barrel, and a plunger. Oil is pumped from a well through a series of "downstrokes" and "upstrokes" of the oil pump, which motion is imparted by the above-ground pumping unit. During the upstroke, formation pressure allows the oil to pass through the standing valve and into the barrel of the oil pump. This oil will be held in place between the standing valve and the traveling valve. On the downstroke, the ball in the travelling valve unseats, permitting the oil that has passed through the standing valve to pass therethrough. Also during the downstroke, the ball in the standing valve seats, preventing pumped oil from moving back down into the hole. The process repeats itself again and again, with oil essentially being moved in stages from the hole, to above the standing valve and in the oil pump, to above the traveling valve, through the top plunger adapter, an out of the oil pump, and into the tubing. Oil continues to pass through the tubing to the surface, where the oil is then directed to a storage tank or other such structure.

Presently known top plunger adapters suffer from several shortcomings in various areas of the design. Particularly in wells with large concentrations of sand, silt or debris, known top plunger adapters do not effectively limit the clogging of the sucker rod pump from these materials. It is noted that the top plunger adapter, being uppermost in the pump configuration, is the first component onto which sand or debris present in the tubing falls. Thus, it would be desired to develop a top plunger adapter that lessens pump clogging.

In the typical operation of a sucker rod pump, the pump periodically shuts down for short periods of time up to several hours in length. During this off time, sand that is suspended in the tubing upstream of the pump tends to settle and fall back on the pump components. Thus, it would be desired to provide a top plunger adapter that directs this falling sand into locations so that the pump will not be harmed. Further, on restarting, it would be desired to provide a top plunger adapter that quickly clears the sand and resuspends it in petroleum.

Additionally, in those wells with a high sand concentration, it is likely that siltification or clogging of the pump will occur at some point. Thus, it would be desired that the top plunger adapter provide a self-cleaning mechanism so as to dislodge clogging that does occur.

Hence there has been identified a need to provide improved sand control with a top plunger adapter. It is desired that the top plunger adapter be robust and provide an improved service life over known pumps, and thereby that top plunger provide an improved cost performance for the pump. It would further be desired that the top plunger adapter allow the sucker rod pump provide an improved pumping efficiency. It would also be desired that an improved top plunger adapter be compatible with existing petroleum production devices. The present invention addresses one or more of these needs.

SUMMARY OF THE INVENTION

In one embodiment, and by way of example only, there is provided a top plunger adapter assembly for use in controlling sand fouling of an oil pump system wherein the oil pump system reciprocates between upstrokes and downstrokes within a barrel, and wherein the oil pump system includes as components a sucker rod and a plunger. In one embodiment, the top plunger adapter assembly includes an adapter having a first end configured to receive a sucker rod, wherein the adapter includes a chamber which allows fluid movement therethrough; a collection cage rotatably mounted to the adapter, the collection cage defining an interior region, and the collection cage having an upper lip configured to direct sand toward the interior region of the collection cage during an upstroke of the pump; and a bottom cage attached to the adapter and the bottom cage having a bottom end configured to attach to a pump plunger, wherein the bottom cage includes a passage to allow fluid communication through the bottom cage to the chamber of the adapter. In one embodiment, the adapter is further configured with a flute section configured to allow fluid movement from the chamber through the flute section during a downstroke of the pump and wherein the flute section is configured to impart a spiral movement in fluid passing through the flute section.

Other independent features and advantages of the top plunger adapter will become apparent from the following detailed description, taken in conjunction with the accompanying drawings which illustrate, by way of example, the principles of the invention.

DETAILED DESCRIPTION OF A PREFERRED EMBODIMENT

The following detailed description of the invention is merely exemplary in nature and is not intended to limit the invention or the application and uses of the invention. Furthermore, there is no intention to be bound by any theory presented in the preceding background of the invention or the following detailed description of the invention. Reference will now be made in detail to exemplary embodiments of the invention, examples of which are illustrated in the accompanying drawings. Wherever possible, the same reference numbers will be used throughout the drawings to refer to the same or like parts.

Figure 1:
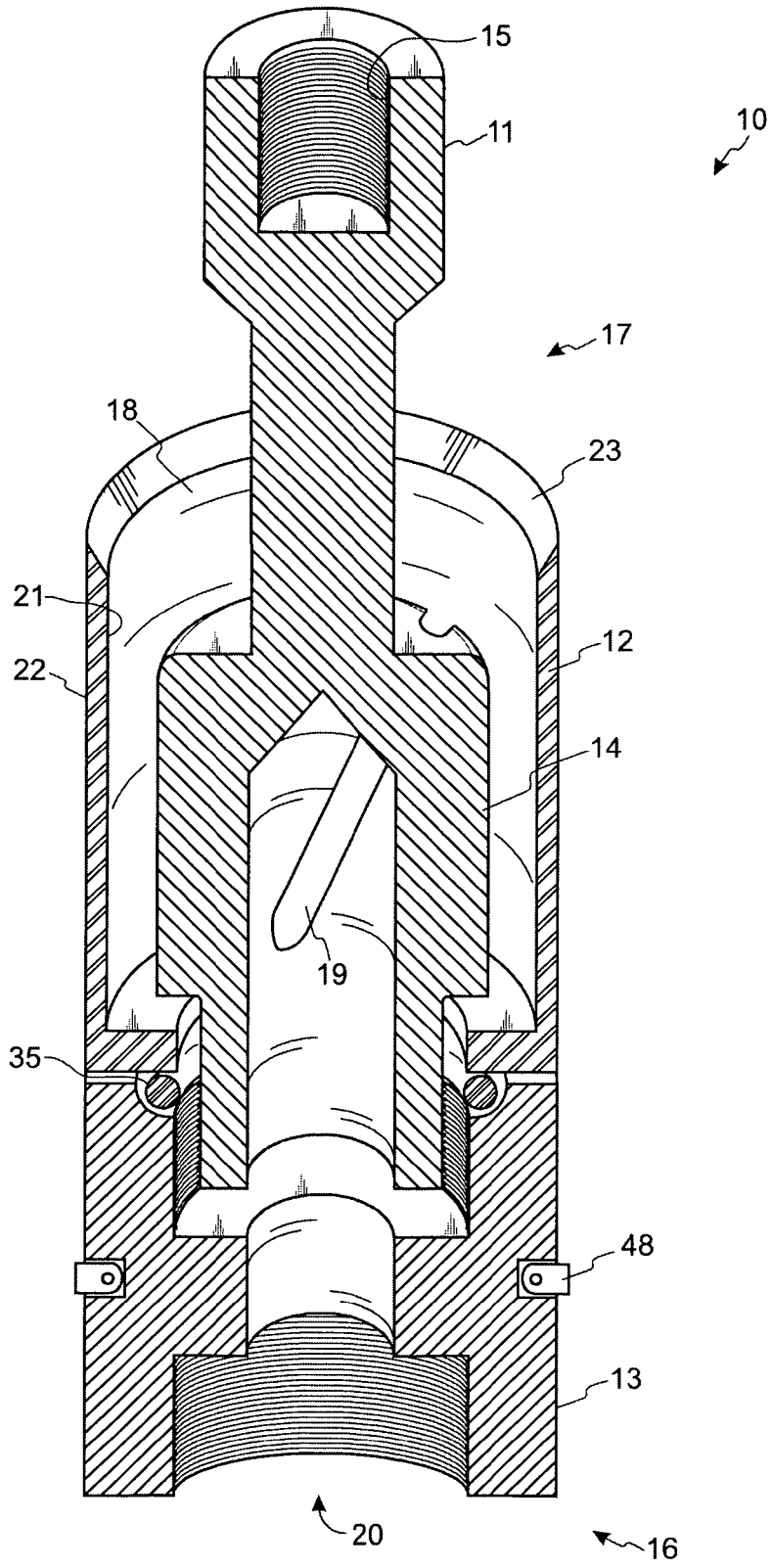
FIG. 1 is a cut away view of a top plunger adapter, according to an embodiment of the present invention.

In a first aspect of the invention, a downhole sucker rod (not shown) is attached to pumping components through a top plunger adapter (TPA). In a preferred embodiment, the TPA is configured as shown in FIG. 1. TPA 10 comprises a sucker rod connector 11 (also sometimes referred to as adapter), a collection cage 12, and bottom cage 13. Sucker rod connector 11 further includes a fluted section 14. Collection cage 12 is rotatably mounted to sucker rod connector 11. Sucker rod connector 11 is provided with a means by which to connect to a sucker rod (not shown) such as threading 15. In an alternative embodiment, sucker rod connector 11 attaches to a valve rod (not shown), which is a final piece in the sucker rod string. The TPA 10 reciprocates in upstrokes and downstrokes along with the sucker rod string. Bottom cage 13 itself may be connected with a downstream portion of the sucker rod pump such as a plunger (not shown) through a known connection means such as reciprocal threading. The TPA 10 defines a chamber 20 that runs the length of TPA 10 so as to provide fluid communication between a lower portion 16 of the TPA and a top portion 17 of the TPA. Chamber 20 thus runs through bottom cage 13 and fluted section 14 of sucker rod connector 11 as described further herein. Thus, TPA 10 provides a means with which to connect a sucker rod to a sucker rod pump with fluid flow through TPA 10. In this manner, fluid, such as petroleum, passes from the sucker rod pump through TPA 10 and into the tubing of the oil well.

Figure 4:
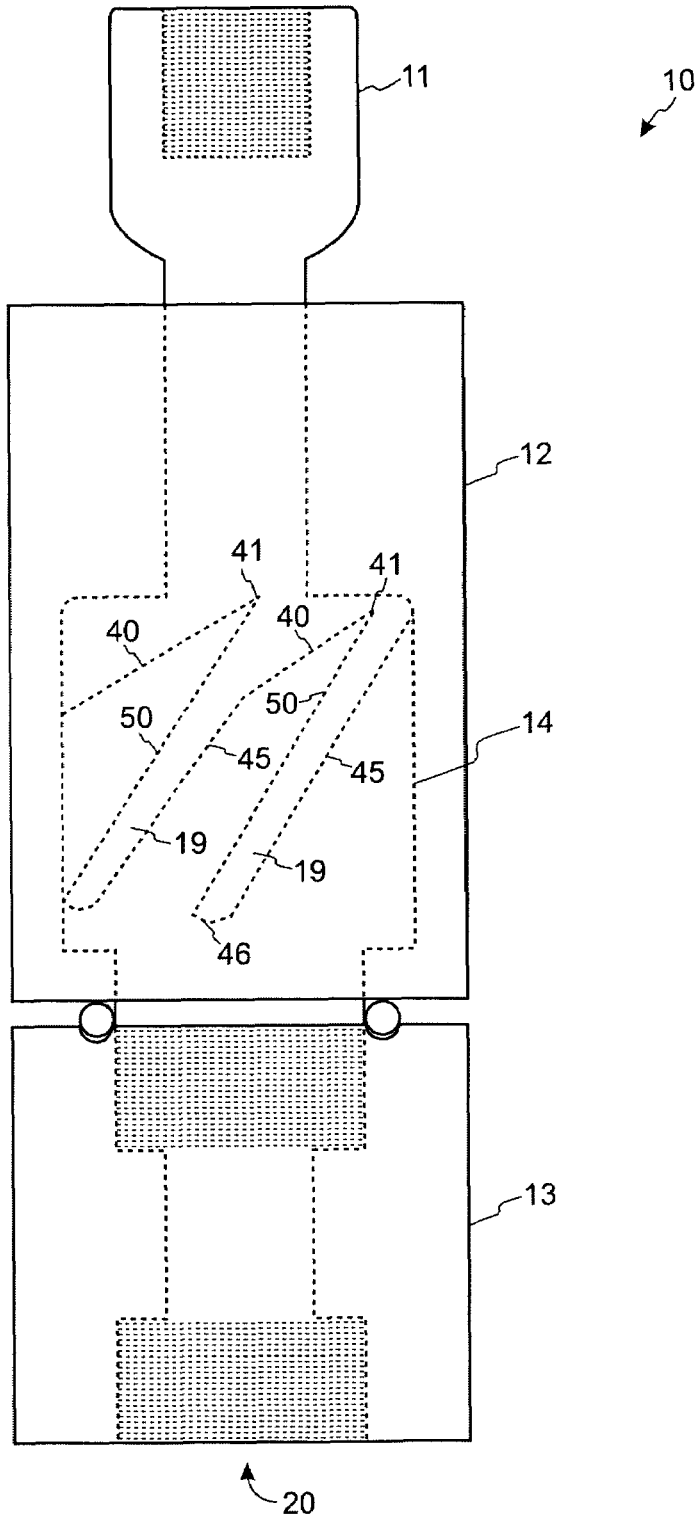
FIG. 4 is an additional view of a top plunger adapter, according to an embodiment of the present invention.

Referring now to FIG. 1 and FIG. 4, collection cage 12 of TPA 10 will be discussed in further detail. In overall appearance, collection cage 12 is preferably shaped in the form of a hollow cylinder such that collection cage 12 includes an outer surface 21 and inner surface 22. Collection cage 12 also includes upper lip 23. Collection cage 12 is sized so that when placed in the pump barrel (not shown) of a sucker rod pump, outer surface 21 comes into close contact with the inner surface of the pump barrel. The close contact is such that no significant amount of sand or fluid is allowed to pass by the boundary between outer surface 21 of collection cage 12 and the barrel. However, in operation of the sucker rod pump, collection cage 12 will move up and down within the pump barrel, thus the contact between collection cage 12 and the barrel cannot be so tight so as to restrict movement. In preferred practice, a tolerance of between approximately 0.002 inches to approximately 0 inches, between outer surface 21 and barrel, is desired.

Still referring to FIG. 1, upper lip 23 of collection cage 12 is seen to preferably form an angled surface. The angle is such that inner surface 22 of collection cage 12 begins at a lower point than outer surface 21. Further, the angle presented by upper lip 23 is such that, as collection cage 12 moves upwardly, debris that contacts upper lip 23 tends to be forced toward the hollow interior region of collection cage by the angled surface. The upper lip 23 thus helps to avoid debris from lodging between outer surface 21 and barrel by moving debris away from that region.

Figure 2:
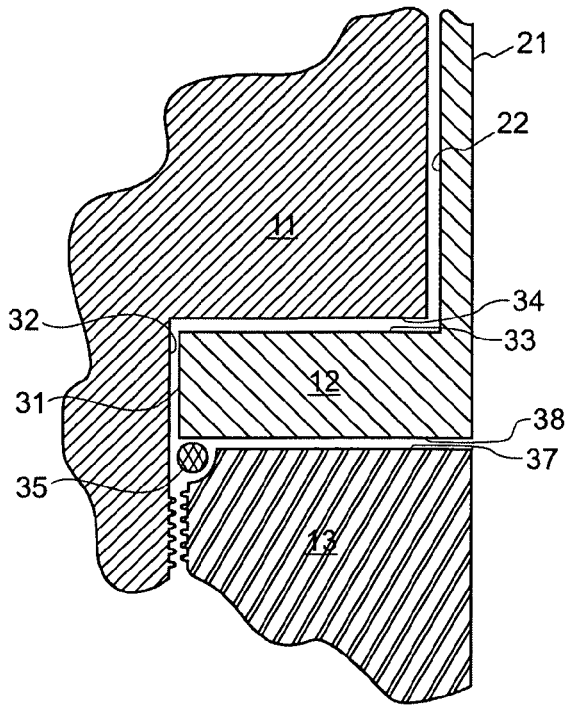
FIG. 2 is a close up view of a portion of a top plunger adapter, according to an embodiment of the present invention.

As previously mentioned, collection cage 12 is rotatably mounted to adapter (sucker rod connector) 11. Referring now to FIG. 2, the details of a preferred method of mounting cage 12 are now described. Collection cage 12 is provided with contact surface 31 that matches a rotation surface 32 on sucker rod connector 11. Preferably contact surface 31 and rotation surface 32 are closely matching cylindrical surfaces; however, it is preferred that some tolerance or float is allowed between them. A typical preferred floating tolerance between these surfaces is between approximately 0.004 to approximately 0.008 inches. It will be appreciated by those skilled in the art that this tolerance allows collection cage 12 to self-align when the pump is assembled into the pump barrel. In the preferred embodiment, contact surface 31 on collection cage 12 further has an upper surface 33. The upper surface 33 can make contact with a stop surface 34 on sucker rod connector 11 so as to limit the axial movement of collection cage 12 relative to adapter 11. Contact between the upper surface 33 and the stop surface 34 can act to restrict axial movement of the collection cage relative 12 to the adapter. Finally, in a preferred embodiment (as shown in FIGS. 1 and 2) an o-ring 35 or similar ring-seal device is preferably provided below collection cage 12 when mounted on adapter 11. In addition to an o-ring, other sealing structures may include a pack seal.

Referring again to FIG. 1, bottom cage 13 attaches to sucker rod connector 11, preferably through a reciprocal threading. In a preferred embodiment, bottom cage 13 comes into proximity with collection cage 12 as bottom cage 13 is attached to sucker rod connector 11. Preferably, bottom cage 13 is provided with a flat surface 37 that matches a reciprocal flat surface 38 provided on collection cage 12 such that the attachment of bottom cage 13 to sucker rod connector 11 brings the flat surface 37 of bottom cage 13 into close proximity with reciprocal flat surface 38 of collection cage 12. Further, as bottom cage 13 is attached to sucker rod connector 11, o-ring 35 is compressed between flat surface 37 and reciprocal flat surface 38. The compression of o-ring 35 assists in providing a seal at the lower boundary between collection cage 12 and connector 11, again avoiding the passage of sand or debris. Also, preferably, the connection between bottom cage 13 and adapter does not restrict the rotation of collection cage 12.

As mentioned, a preferred method of connecting bottom cage 13 to adapter 11 is through the use of reciprocal threading. At an opposite end, bottom cage 13 will also connect to a pump plunger (not shown), again preferably through reciprocal threading. It is thus preferred to make the two sets of differently-sized threads on the bottom cage 13, a first set of threads to match the adapter 11 and a second set of threads to match the plunger. Due to the distinct size of the threads, it would not be possible to mistakenly connect the plunger end of bottom cage 13 to the adapter 11.

In a preferred embodiment, the outer diameter of bottom cage 13 is preferably somewhat less that the outer diameter of collection cage 12 (shown in FIG. 2). Thus, in traveling through the pump barrel, bottom cage 13 will not restrict the reciprocal pump movement; nor, being smaller in diameter, will the bottom cage 13 cause alignment difficulties. In a preferred embodiment, bottom cage 13 is approximately 0.010 to approximately 0.030 inches smaller than the barrel in diameter.

The advantage of the preferred method of mounting collection cage 12 to adapter 11 is realized when it is attempted to load the pump assembly into a pump barrel. The fact that collection cage 12 is rotatably mounted with a floating tolerance allows collection cage 12 to self-align as it travels through the barrel. If, for example, the collection cage 12 were rigidly mounted, a partial misalignment of collection cage 12 would potentially cause it to seize or stick as it slides through the barrel.

A further feature of an embodiment of the top plunger adapter 10 is illustrated in FIG. 1. The interior region 18 of collection cage 12 defines a generally cylindrical-shaped space. During assembly of TPA 10, the fluted section 14 of adapter 11 passes into the interior region 18 of collection cage 12. The outer diameter of fluted section 14 is such that fluted section 14 can pass into the interior region 18 and still allow collection cage 12 to rotate. The rotation of collection cage 12 allows inner surface 22 of collection cage to rotate around the outer diameter of fluted section 14. However, it is undesirable to have an overly large tolerance between fluted section 14 and inner surface 22 of collection cage 12. An overly large clearance is not desired because this may allow an undue amount of sand particles to lodge between the walls of fluted section 14 and collection cage 12. Rather, if a relatively close fit is achieved, the majority of sand particles will fall into the flutes 19 of fluted section 14. When sand is trapped within the space of the flutes 19, the sand will then be agitated during each upstroke as petroleum fluid passes in turbulent flow through the flutes 19. The cyclonic flow of fluid through flutes 19 will provide a fluid momentum that picks up the sand particles and carries them upward and out of the interior region 18 of collection cage 12, thus providing a self-cleaning effect.

It is also noted that the bottom of flutes 19 in fluted section 14 is positioned proximate to the bottom of interior region 18. This positioning is preferred so that fluid passing through flutes 19 will pick up and carry with the fluid sand that may be positioned at the bottom of the flutes 19. Thus, it is preferred that the bottom of the flutes 19 be close enough to the bottom of the interior region 18 so that fluid movement will pick up sand at the bottom of the flute. In a preferred embodiment, bottom curve 46 of flutes 19 is canted or angled so that solids falling on bottom curve 46 are directed toward chamber 20. Also, this angled shape of bottom curve 46 restricts solids from moving toward the outer diameter of fluted section 14.

Thus, it will be seen that a preferred embodiment of the TPA achieves sand control through a combination of mechanisms. (It is here noted that while this disclosure describes sand, it is equally applicable to other particulate matter present in petroleum fluid). First, sand positioned above the TPA that falls downward encounters upper lip 23 of collection cage 12. (This downward movement of sand may be encountered because the pump is moving on an upstroke, or if the pump is temporarily inactive—a typical part of normal pump operation—because of gravitational settlement.) The angled surface of upper lip 23 directs this sand away from the barrel wall and toward interior region 18 of collection cage 12. And, because TPA 10 is positioned above the plunger, and because the fit between collection cage 12 and the interior barrel wall is preferably closer than the fit of the plunger and the barrel wall, collection cage 12 thus acts as a first and best line of prevention for the movement of sand between the barrel wall and other components. This line of prevention is advantageously positioned—at the top of the pump system.

A second mechanism of sand control is the evacuation of sand that gathers in the interior region of collection cage 12. From the step above, sand is directed to the interior region of collection cage 12. The sand is generally directed to the flute areas of the flute section 14 as described above. When the pump is active, fluid flows through the flute section 14 of adapter 11. The flute section 14 induces a cyclonic motion on the fluid. The fluid picks up the sand in the flute area and carries it out of the interior region and above TPA 10. Further, the cyclonic motion of the fluid, which is also imparted onto the sand particles suspended in the fluid, acts to further suspend the sand particles.

A third mechanism of sand control arises in connection with the rotation of collection cage 12. The fact that collection cage 12 is allowed to freely rotate means that the cage 12 and flute section 14 are self-cleaning. If, for example, sand does become lodged between the flute wall and the interior wall of interior region 18, the rotation of collection cage 12 will eventually move that sand to a flute. At that location the sand will be picked up by fluid movement and flushed out as described before. The o-ring or other seal positioned between collection cage 12 and bottom cage 13 additionally provides seal at the seam between these parts and further prevents sand from passing through.

As was described above, collection cage 12 acts as a means of preventing sand from slipping between the interior barrel wall and other system components. It is further noted that, preferably, collection cage is shorter relative to other pump components such as the plunger. In one preferred embodiment, collection cage 12 is less than 12 inches in length. Plungers may be several feet in length. This shortness of collection cage 12 means that friction forces that develop from the close contact between collection cage 12 and the barrel wall will not unduly restrict movement of the pump components. Thus, an improved level of sand control is achieved with no undue increase in friction. Moreover, any gain in friction that arises from the use of collection cage 12 can be offset by using a smaller diameter plunger than would otherwise be specified. The degree of sand control achieved by embodiments of the present invention allow for that option. Further, TPA 10 is designed to be assembled with stock plungers and sucker rods.

Still referring to FIG. 1, sucker rod connector 11 includes fluted section 14, a preferred embodiment of which will now be described in greater detail. Generally, chamber 20 is in fluid communication with fluted section 14 which itself includes a plurality of flutes 19 so that fluids entering connector 11 through chamber 20 pass through fluted section 14 and exit connector 11 through flutes 19. Fluid passing through flutes 19 exits to interior region 18 of collection cage 12. Thus fluted section 14 provides a link in the overall fluid flow through TPA 10.

Figure 3:
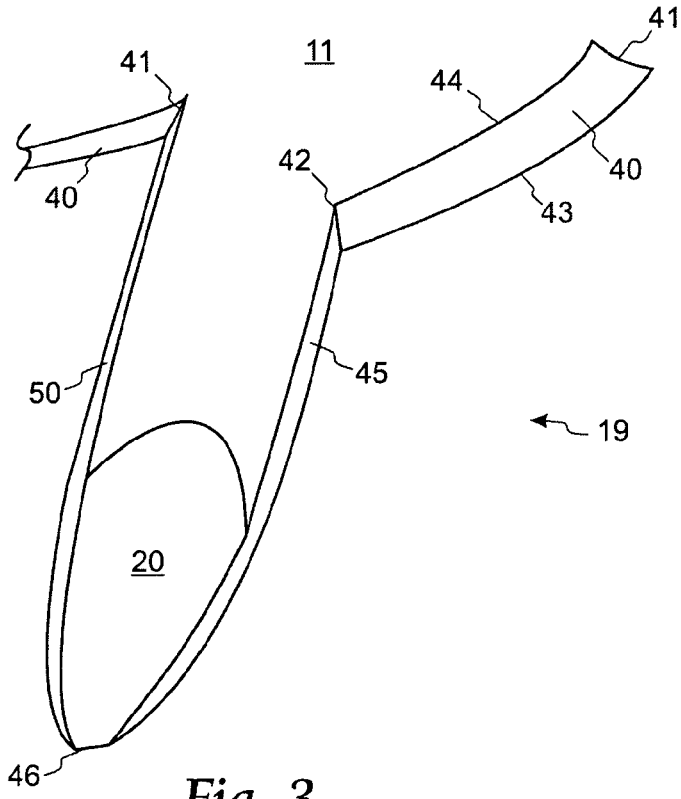
FIG. 3 is a close up view of a flute, according to an embodiment of the present invention.

Referring now to FIGS. 1, 3, and 4, further features of fluted section 14 are described. In a preferred embodiment, surfaces define flutes 19 so as to direct fluid flow as well as solid flow therethrough. As best illustrated in FIG. 3, each flute 19 is defined by shoulder surface 40, floor surface 45, and a ceiling surface 50. The preferred shape and alignment of these surfaces is set so that falling sand tends to be directed inward, into flute 19 and chamber 20 rather than outward.

In the preferred embodiment, shoulder surface 40 begins at upper corner 41 and extends to shoulder joint 42. Shoulder surface 40 is further defined by outer radial line 43 and inner radial line 44. Preferably shoulder surface 40 extends downwardly from upper corner 41 toward shoulder joint 42. Further, shoulder surface 40 is preferably canted so that shoulder surface 40 tilts inwardly from outer radial line 43 toward inner radial line 44. Shoulder surface 40 in one embodiment is substantially planar. In an alternative embodiment, shoulder surface 40 is curved and has some concavity Still referring to FIG. 3, an embodiment of floor surface 45 extends from shoulder joint 42 in a downward direction. In one embodiment, floor surface 45 terminates in a bottom position with bottom curve 46. Floor surface 45 preferably terminates in a smooth curved transition to bottom curve 46, though other, sharply defined termination points are possible. A curved shape in bottom curve 46 is preferred for ease in manufacturing. Floor surface 45 is preferably canted so that surface 45 tilts inwardly.

An embodiment of ceiling surface 50 is also illustrated in FIG. 3. Ceiling surface 50 extends from an upward position at an upper corner 41 and extends downwardly until terminating in bottom curve 46. As with floor surface 45, ceiling surface 50 preferably terminates in a curved bottom curve 46 though other configurations are possible.

An explanation of the function and use of fluted section 14 will further illustrate the significance of the geometry of the surfaces included therein. Prior art TPAs tend to exhaust fluids in a linear direction, for example, against the tubing. When high solids are present in the fluids, the fluid exhaust through prior art TPAs tends to erode through the tubing such that reinforcing pieces are sometimes necessary. The embodiments of the TPA 10 disclosed herein allow for improved management and control of high solids fluids so that degradation and erosion of tubing is lessened. In contrast, the shape and spiral alignment of flutes 19 tends to exhaust fluid therethrough with a spiral or cyclonic motion. This cyclonic fluid motion helps to suspend solids in the fluid, thus limiting the fall back of solids. Additionally, the cyclonic, rotational movement of fluid lessens the impact of the fluid against neighboring surfaces. Finally, the fluid is exhausted into interior region 18 so that erosion of tubing is avoided.

Referring again to FIG. 1, bottom cage 13 is configured to connect to adapter 11. The connection between bottom cage 13 and adapter 11 also brings an upper portion of bottom cage 13 into contact with o-ring 35. Preferably, o-ring 35 is compressed by the assembly so as to seal the space between collection cage 12 and adapter 11. When assembled, the connection of bottom cage 13 is such that it also restricts the lateral movement of collection cage 12.

In a further embodiment, the top plunger adapter 10 may include a wiper seal 48. As shown in FIG. 1, wiper seal 48 may be disposed on the outer surface of bottom cage 13. Alternatively, wiper seal 48 may be disposed proximate the junction of bottom cage 13 and collection cage 12. The function of wiper seal 48 is to provide a further seal between TPA 10 and the pump barrel. Wiper seal 48 may function as a sacrificial seal so that during the initial start up of the pump it additionally provides a fluid seal in the barrel as well as an obstacle for sand flow.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A top plunger adapter assembly for use in controlling sand fouling of an oil pump system wherein the oil pump system reciprocates between upstrokes and downstrokes within a barrel, and wherein the oil pump system includes as components a sucker rod and a plunger, the top plunger adapter assembly comprising:

an adapter having a first end configured to receive a sucker rod, wherein the adapter includes a chamber which allows fluid movement therethrough;

a collection cage rotatably mounted to the adapter, the collection cage defining an interior region, and the collection cage having an upper lip configured to direct sand toward the interior region of the collection cage during an upstroke of the pump;

a bottom cage attached to the adapter and the bottom cage having a bottom end configured to attach to a pump plunger, wherein the bottom cage includes a passage to allow fluid communication through the bottom cage to the chamber of the adapter; and wherein the adapter is further configured with a flute section configured to allow fluid movement from the chamber through the flute section during a downstroke of the pump and wherein the flute section is configured to impart a spiral movement in fluid passing through the flute section.

2. The top plunger adapter assembly according to claim 1 further comprising a means for sealing disposed between the collection cage and the bottom cage.

3. The top plunger adapter assembly according to claim 1 further comprising a wiper seal disposed on the bottom cage.

4. The top plunger adapter assembly according to claim 1 wherein the adapter further defines a rotation surface and wherein the collection cage further defines a contact surface such that the collection cage is rotatably mounted on the adapter by bringing the contact surface into proximity with the rotation surface.

5. The top plunger adapter assembly according to claim 4 wherein the collection cage and adapter have a floating tolerance that allows the collection cage to self-align.

6. The top plunger adapter assembly according to claim 5 wherein the floating tolerance is between approximately 0.004 to approximately 0.008 inches.

7. The top plunger adapter assembly according to claim 4 wherein the adapter further comprises a stop surface and the contact surface of the collection cage further defines an upper surface so that contact between the upper surface and the stop surface restricts axial movement of the collection cage relative to the adapter.

8. The top plunger adapter assembly according to claim 1 wherein the collection cage comprises an outer surface and is configured such that the outer surface of the collection cage closely contacts the pump barrel.

9. The top plunger adapter assembly according to claim 8 wherein the close contact between the outer surface of the collection cage and the pump barrel allows a tolerance of between approximately 0 to approximately 0.002 inches.

10. The top plunger adapter assembly according to claim 1 wherein the flute section further comprises a plurality of flutes including a shoulder surface, floor surface, and ceiling surface.

11. The top plunger adapter assembly according to claim 1 wherein the upper lip of the collection cage comprises an angled surface configured so as to move fluid toward the interior region of the collection cage during an upstroke of the pump.

12. The top plunger adapter assembly according to claim 1 wherein the fluid discharge through the flutes is substantially directed toward the interior region of the collection cage.

13. An assembly for use as a top plunger adapter in an oil pump system wherein the oil pump system reciprocates between upstrokes and downstrokes within a barrel, and wherein the oil pump system includes as components a sucker rod and a plunger, the assembly comprising:

an adapter having a first end configured to receive the sucker rod, wherein the adapter includes a chamber which allows fluid movement therethrough;

a collection cage rotatably mounted to the adapter, the collection cage defining an interior region, and the collection cage having an upper lip configured to direct sand toward the interior region of the collection cage during an upstroke of the pump;

a bottom cage attached to the adapter and the bottom cage having a bottom end configured to attach to a pump plunger, wherein the bottom cage includes a chamber to allow fluid communication through the bottom cage to the chamber of the adapter; and wherein the adapter is further configured with a flute section defining a plurality of flutes, wherein the flute section and flutes are configured to allow fluid movement from the chamber through the flute section during a downstroke of the pump such that a spiral movement is imparted on fluid passing through the flute section.

14. The assembly according to claim 13 wherein each flute comprises a shoulder surface, a floor surface, a ceiling surface, and a bottom curve.

15. The assembly according to claim 13 wherein the shoulder surface, floor surface, and bottom curve are disposed such that solids in the fluid falling onto the shoulder surface and the floor surface are moved toward the chamber.

16. The assembly according to claim 13 wherein the interior region of the collection cage defines a bottom, and wherein the flute section defines a bottom such that the bottom of the interior region is proximate the bottom of the flute section.

17. The assembly according to claim 16 wherein fluid flowing through the flutes carries sand at the bottom of the interior region.

18. The assembly according to claim 13 further comprising means for sealing disposed between the collection cage and the bottom cage.

19. The assembly according to claim 13 further comprising a wiper seal disposed on the bottom cage.

20. The assembly according to claim 13 wherein the collection cage and adapter have a floating tolerance that allows the collection cage to self-align.

* * * * *